US007997236B2

(12) United States Patent
Pussell

(10) Patent No.: US 7,997,236 B2
(45) Date of Patent: Aug. 16, 2011

(54) WATER HEATER AND A METHOD OF OPERATING SAME

(75) Inventor: Patrick Pussell, Pyrmont (AU)

(73) Assignee: Dux Manufacturing Limited, New South Wales (AU)

( * ) Notice: Subject to any disclaimer, the term of this patent is extended or adjusted under 35 U.S.C. 154(b) by 844 days.

(21) Appl. No.: 11/575,991

(22) PCT Filed: Sep. 16, 2005

(86) PCT No.: PCT/AU2005/001418

§ 371 (c)(1),
(2), (4) Date: Feb. 15, 2008

(87) PCT Pub. No.: WO2006/045139

PCT Pub. Date: May 4, 2006

(65) Prior Publication Data

US 2009/0025653 A1 Jan. 29, 2009

(30) Foreign Application Priority Data

Oct. 27, 2004 (AU) ..... 2004906203

(51) Int. Cl.
*F22B 1/28* (2006.01)
*F24H 1/22* (2006.01)

(52) U.S. Cl. ..... 122/13.01; 122/4 A; 392/451; 392/453

(58) Field of Classification Search ..... 122/4 A, 122/13.01, 157, 158, 159, 367.1, 367.2, 166.1, 122/168, 169; 392/441, 451, 453, 497
See application file for complete search history.

(56) References Cited

U.S. PATENT DOCUMENTS

| | | | | | |
|---|---|---|---|---|---|
| 1,953,994 | A * | 4/1934 | Stone | ..... | 392/452 |
| 2,377,785 | A * | 6/1945 | Hudson | ..... | 392/492 |
| 2,636,974 | A * | 4/1953 | Bowen | ..... | 392/452 |
| 3,614,386 | A * | 10/1971 | Hepplewhite | ..... | 392/452 |
| 6,321,036 | B1 * | 11/2001 | Huang | ..... | 392/453 |

FOREIGN PATENT DOCUMENTS

| | | | |
|---|---|---|---|
| FR | 2783903 | A1 * | 3/2000 |
| FR | 2783905 | A1 * | 3/2000 |
| GB | 2209821 | A * | 5/1989 |
| WO | WO 9857100 | * | 12/1998 |

* cited by examiner

*Primary Examiner* — Gregory A Wilson
(74) *Attorney, Agent, or Firm* — Fenwick & West LLP

(57) ABSTRACT

A water heater (10) including a tank (12) adapted for mounting with its longitudinal axis substantially vertical and a duct (32) adapted for mounting with its longitudinal axis substantially vertical. The duct (32) is positioned within the tank (12) and extends through at least most of the height of the tank (12). The duct (32) defines a first volume (34) within the duct interior and a second volume (36) between the duct exterior and the tank interior. The first volume (34) being smaller than the second volume (36). The duct (32) has at least one upper opening (38) at or near the top of the duct (32) and at least one lower opening (40) at or near the bottom of the duct (32). The heater (10) also has a heating element (44) within, or forming all or part of, the duct (32). The element (44) extends at least substantially through the upper half of the duct (32). The heater (10) also has an inlet (24) at or near the bottom of the tank (12) and an outlet (22) at or near the top of the tank (12). In use, energising the heater element (44) causes water to flow from the first volume (34) to the second volume (36) through the upper opening(s) (38) and water to flow the second volume (36) to the first volume (34) through the lower opening(s) (40).

28 Claims, 9 Drawing Sheets

WATER HEATER AND A METHOD OF OPERATING SAME

This application is the National Stage of International Application No. PCT/AU2005/001418, published in English under PCT Article 21(2), filed Sep. 16, 2005, which claims priority to Australian Application No. 2004906203, filed Oct. 27, 2004, both of which are incorporated by reference in their entirety.

FIELD OF THE INVENTION

The present invention relates to a water heater and a method of operating same.

The invention has been primarily developed for use in domestic, electric hot water heaters and will be described hereinafter with reference to this application. However, the invention is not limited to this particular use and is also suitable for use with a gas flue heating element or a heat pump heat exchanger.

BACKGROUND OF THE INVENTION

Known domestic, electric water heaters have a water tank with a cold water inlet near the bottom of the tank and a hot water outlet near the top of the tank. An internal heating element is positioned near the bottom of the tank. This arrangement has several disadvantages.

Firstly, the entire volume of water in the tank must be heated from bottom to top in order to provide hot water at the outlet, which is not energy efficient.

Secondly, much care must be taken when admitting fresh cold water to the tank so as not to disturb the rising segments of heated water. This normally requires the use of, for example, diffusers to slow the rate of cold water entering the tank, which adds to the complexity and cost of the water heater. This problem is exacerbated if, for example, the electric water heater tank is connected in parallel with a solar water heater.

It is an object of the present invention to substantially overcome or at least ameliorate one or more of the prior art deficiencies.

SUMMARY OF THE INVENTION

Accordingly, in a first aspect, the present invention provides a water heater including:

a tank adapted for mounting with its longitudinal axis substantially vertical;

a duct adapted for mounting, with its longitudinal axis substantially vertical, within the tank and extending through at least most of the height of the tank, the duct defining a first volume within the duct interior and a second volume between the duct exterior and the tank interior, the first volume being smaller than the second volume, the duct having at least one upper opening at or near the top of the duct and at least one lower opening at or near the bottom of the duct;

a heating element within, or forming all or part of, the duct, the element extending at least substantially through the upper half of the duct;

an inlet at or near the bottom of the tank; and an outlet at or near the top of the tank, wherein, in use, energising the heater element causes water to flow from the first volume to the second volume through the upper opening(s) and water to flow the second volume to the first volume through the lower opening(s).

In one embodiment, the heating element is separate from, and positioned within, the duct. In one form, the duct is an open ended cylinder with the heating element positioned within the interior of the cylinder.

In another embodiment, the heating element forms the duct and vice versa. In one form, the heating element is generally cylindrical in shape and formed from tightly spiraled hollow tube adapted for having heated fluid flowing therethrough. In another form, the heating element is generally cylindrical in shape and formed from tightly spiraled hollow tube adapted for having a heated fluid flowing therethrough and has an open ended cylinder on its exterior surface. In yet another form, the heating element is generally cylindrical in shape and formed from tightly spiraled hollow tube adapted for having heated fluid flowing therethrough and has an open ended cylinder on its interior surface. In yet a further form, the heating element is generally cylindrical in shape and formed from tightly spiraled hollow tube adapted for having heated fluid flowing therethrough and has open ended cylinders on its interior and its exterior surfaces respectively.

Depending on application, the hollow tube can be single or double walled.

In one embodiment, the duct extends through all of the tank height and has lower opening(s) formed therein. In one variation of this embodiment, the duct also includes at least one intermediate opening between the upper and lower openings, wherein, in use, the colder water also flows from the second volume to the first volume through the intermediate openings. In another variation of this embodiment, the duct includes a flow restrictor between the upper and lower openings.

In another embodiment, the duct lower end terminates above the bottom of the tank to leave a gap between the duct lower end and the tank bottom, the gap defining said lower opening(s). The duct preferably extends through about 70-90% of the height of the tank. In one variation of this embodiment, the duct also includes at least one intermediate opening between the upper and lower openings, wherein, in use, the colder water also flows from the second volume to the first volume through the intermediate openings. In another variation of this embodiment, the duct includes a flow restrictor between the upper and lower openings. In yet another variation of this embodiment, the duct includes a flow restrictor at or near said lower opening.

Preferably, there are a first plurality of upper openings, a second plurality of lower openings, and a third plurality of intermediate openings.

The total size of the upper openings is preferably approximately double the total size of the lower openings and quadruple the total size of the intermediate openings.

In one form, all of the openings are the same size and the first plurality is approximately 25% larger than the combined total of the second and third pluralities.

The intermediate openings are preferably approximately midway between the upper and lower openings.

The tank preferably has two outlets at or near the top of the tank. The tank preferably has two inlets at or near the bottom of the tank.

The duct is preferably adapted for mounting with its longitudinal axis common with the longitudinal axis of the tank.

The tank preferably includes an opening in one end adapted to allow passage of the duct therethrough, most preferably in the upper end.

In a second aspect, the present invention provides a method of operating a water heater, the heater including:

a tank adapted for mounting with its longitudinal axis substantially vertical;

a duct adapted for mounting, with its longitudinal axis substantially vertical, within the tank and extending through at least most of the tank height, the duct defining a first volume within the duct interior and a second volume between the duct exterior and the tank interior, the first volume being smaller than the second volume, the duct having openings therein;

a heating element within, or forming part of, the duct, the element extending at least substantially through the upper half of the duct;

an inlet at or near the bottom of the tank; and an outlet at or near the top of the tank, the method comprising the steps of:

admitting colder water through the inlet;

energising the heater to heat the water in the first volume;

directing the hotter water from the first volume to the second volume at or near the top of the duct;

directing colder water in the second volume to the first volume at or near the bottom of the duct; and thereby providing hotter water at the outlet.

Preferably, the method also includes the step of directing colder water in the second volume to the first volume via a flow restrictor at or near the bottom of the duct.

Preferably, the method also includes the step of directing colder water in the second volume to the first volume at or near the middle of the duct.

Preferably, the method also includes the step of directing colder water in the second volume to the first volume via a flow restrictor at or near the middle of the duct.

In a third aspect, the present invention provides a method of assembling a water heater, the method comprising the steps of:

providing a tank with an opening in one end;

inserting a duct into the tank through the opening; and inserting a heating element into the duct.

In a fourth aspect, the present invention provides a method of assembling a water heater, the method comprising the steps of:

providing a tank with an opening in one end;

assembling a duct with an integral heating element therein; and inserting the duct into the tank through the opening.

BRIEF DESCRIPTION OF THE DRAWINGS

Preferred embodiments of the invention will now be described, by way of examples only, with reference to the accompanying drawings, in which.

DETAILED DESCRIPTION OF THE PREFERRED EMBODIMENTS

Figure 1:
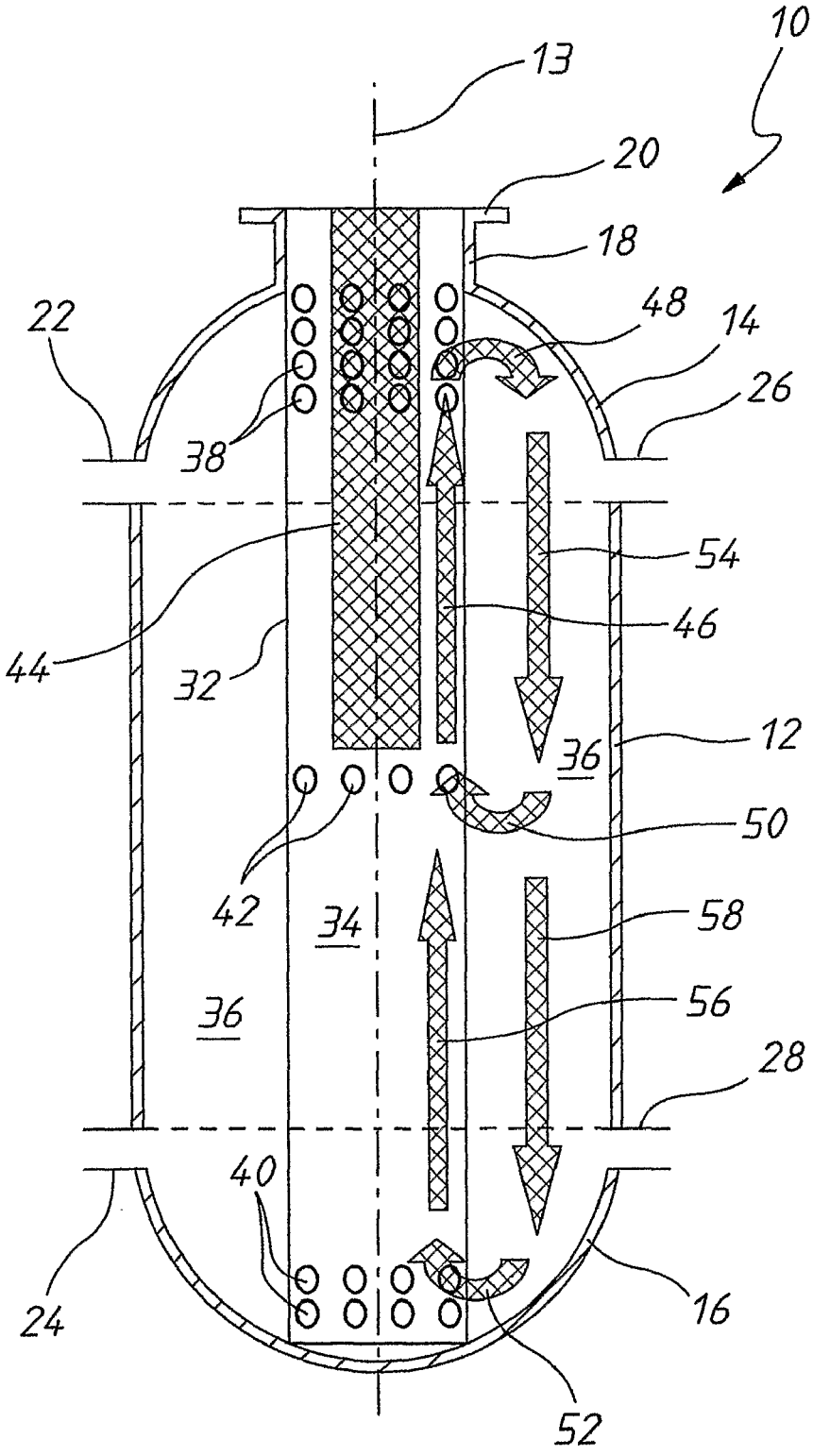
FIG. 1 is a schematic cross-sectional side view of a water heater according to a first embodiment of the invention.

FIG. 1 shows a first embodiment of a domestic, electric water heater 10 according to the present invention. The water heater 10 includes a 250 litre volume, insulated metal, cylindrical tank 12 with a longitudinal axis 13 and upper and lower domed ends 14 and 16 respectively. The tank 12 is mounted with the axis 13 substantially vertical. The upper domed end 14 has a central necked opening 18 with an external flange 20.

The tank 12 also has a first hot water outlet 22 in the upper domed end 14 and a first cold water inlet 24 in the lower domed end 16. The outlet 22 is, in operation, connected to household plumbing. The inlet 24 is, in operation, connected to mains water supply. The tank 12 also has a second hot water outlet 26 and a second cold water inlet 28 which, for example, can be used to connect the tank 12 in parallel to a solar hot water heater.

A cylindrical duct 32 is provided within the tank 12. The duct 32 serves to divide the is internal volume of the tank into a first volume 34, within the interior of the duct 32, and a second volume 36, between the interior of the tank 12 and the exterior of the duct 32. The tank 12 is mounted with its longitudinal axis substantially vertical and corresponding to the axis 13 of the tank 12.

The duct 32 has a first series of upper openings 38 near its top, a second series of lower openings 40 near its bottom and a third series of intermediate openings 42 midway along the duct 32 and between the upper and lower openings 38 and 40 respectively. The total surface area of the upper openings 38 is larger than the combined surface area of the lower and intermediate openings 40 and 42. In the preferred form shown, the upper openings 38 are approximately twice the area of the lower openings 40 and approximately four times the area of the intermediate openings 42. All of the openings are preferably formed by punching holes in a metal sheet, prior to that sheet being rolled into a cylinder to form the duct 32. The top of the tank 12 is sealed by a cover (not shown) bolted to the flange 20.

A heating element 44, which in the preferred form shown is an electric heating element, is mounted within the interior of the duct 32 to extend from the top of the duct 32 to about the middle of the duct 32 (i.e. in the upper half of the duct 32).

The operation of the water heater 10 will now be described. When the water heater 10 is initially filled, or initially activated, all of the water in the tank 12 is relatively cold. When the heating element 44 is energised the adjacent water in the top half of the first volume 34 is initially heated. This naturally causes this heated water to rise, as indicated by arrow 46, and then flow through the first openings 38 from the first volume 34 to the second volume 36, as indicated by arrow 48. This rising heated water creates a relatively low pressure in the duct 32 which draws relatively cooler water through the lower and intermediate openings 40 and 42, from the second volume 36 to the first volume 34, as indicated by arrows 50 and 52 respectively. This water movement creates a natural thermo-syphon within the tank 12 that continually draws colder water from the second volume 36 into the first volume 34 for heating by the heating element 44, as indicated by the remaining arrows 54, 56, and 58.

The water temperature is thermostat controlled to approximately 60 degrees Celsius. Use of a high energy element 44 allows 60 degrees Celsius water to be provided to the outlet 22 after only a single recirculation of water through the duct 32. Alternatively, a low energy element 44 can be used to provide 60 degrees Celsius water at the outlet 22 after numerous recirculations.

The heating process and water circulation described above has numerous advantages. Firstly, as the heating element 44 initially only heats the smaller amount of water in the upper half of the duct 32 (as opposed to heating the entire tank volume), it can provide a supply of heated water relatively quickly and efficiently, and directly to the outlet 22.

Secondly, cold water can be admitted through the cold water inlet 24 (and, if desired, the inlet 28) without any flow restrictions as there is no requirement to avoid disturbing any heated water adjacent the bottom of the tank 12. This simplifies construction and operation of the water heater 10.

Figure 3:
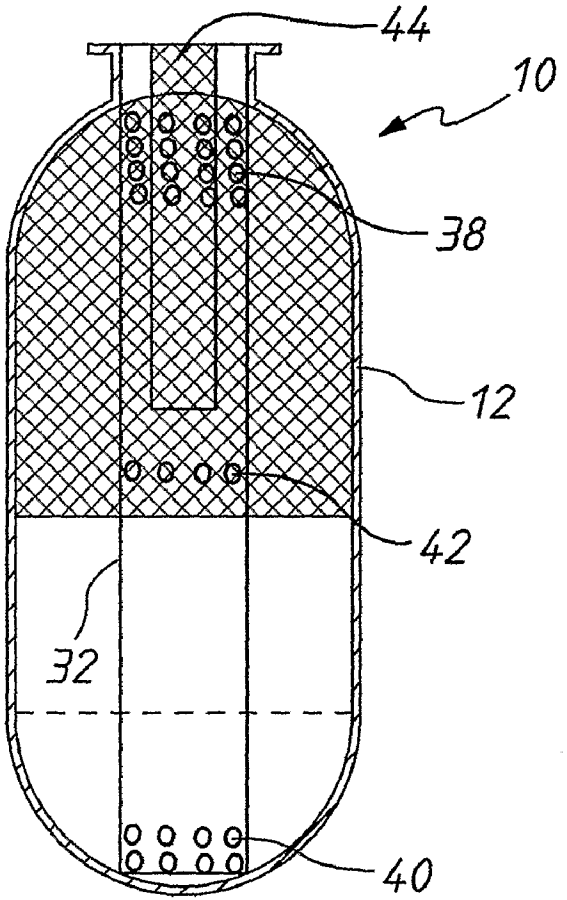
FIG. 3 is a schematic cross-sectional side view of the water heater shown in FIG. 1 during operation in reduced power mode.
Figure 2:
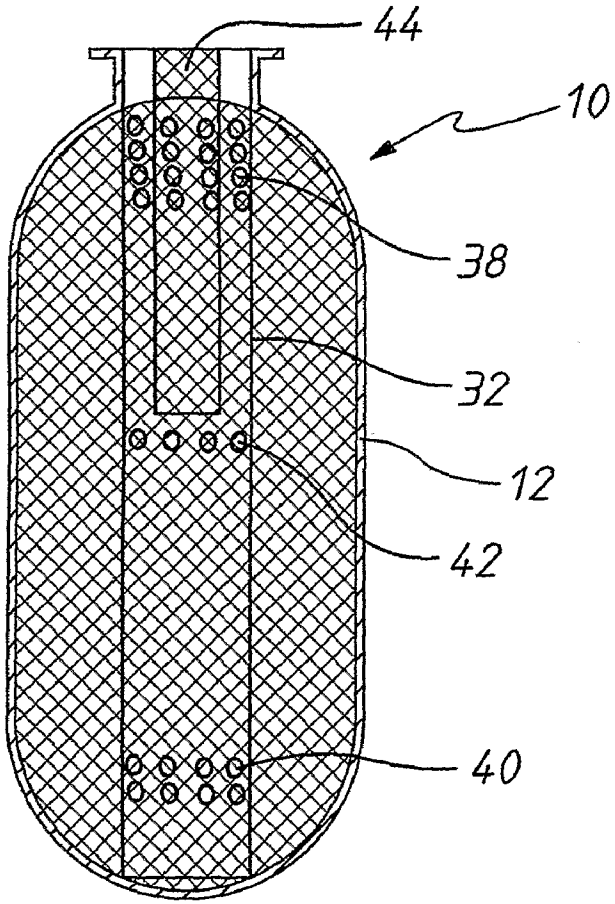
FIG. 2 is a schematic cross-sectional side view of the heater shown in FIG. 1 during operation in full power mode.

Thirdly, as indicated in FIG. 2 by shading, the heating element 44 can be energised to provide thermo-syphoning through the entire volume of the tank 12 and thus heat the entire tank volume. This is, for example, suitable for a large household. However, as indicated in FIG. 3 by shading, for smaller households or lower usage requirements, the heating element 44 can be operated cyclically, or with reduced power, to restrict the thermo-syphoning to only approximately between the upper and intermediate openings Accordingly, only the upper half volume of the tank 12 is heated, thereby conserving energy.

Fourthly, the water heater 10 is very simple to construct given that the duct 32 can be simply inserted through the opening 18 and the heating element 44 can be similarly inserted into the duct 32.

Figure 4:
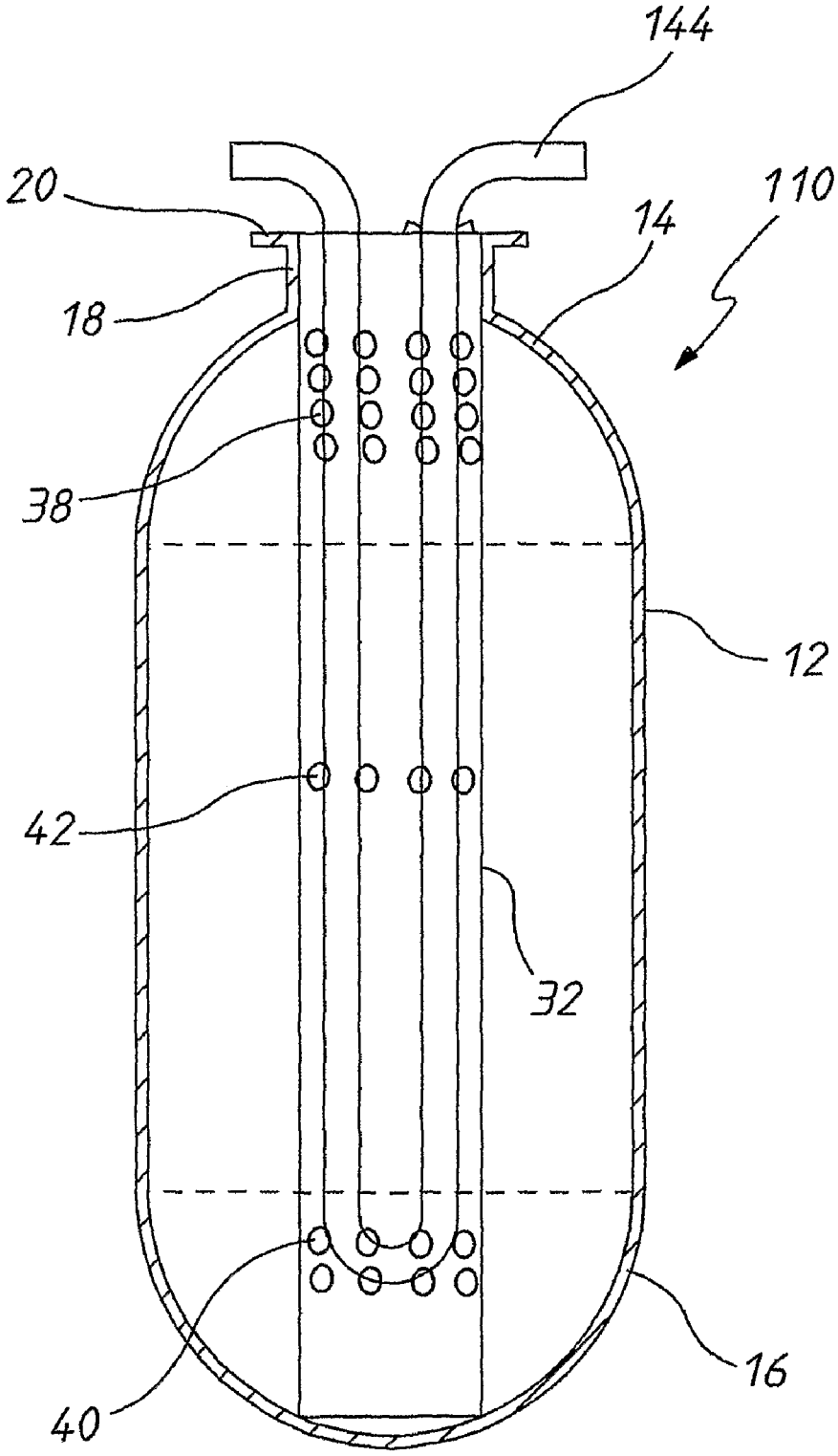
FIG. 4 is a schematic cross-sectional side view of a water heater according to a second embodiment of the invention.

Further, the water heater 10 can be very quickly and easily adapted for other uses simply by changing the heating element 44. This is exemplified in FIG. 4 which shows a second embodiment of a water heater 110 that uses a gas powered heating element 144 (inlets and outlets not shown). Like features in the second embodiment to those used in describing the first embodiment are indicated with like reference numerals.

Figure 5:
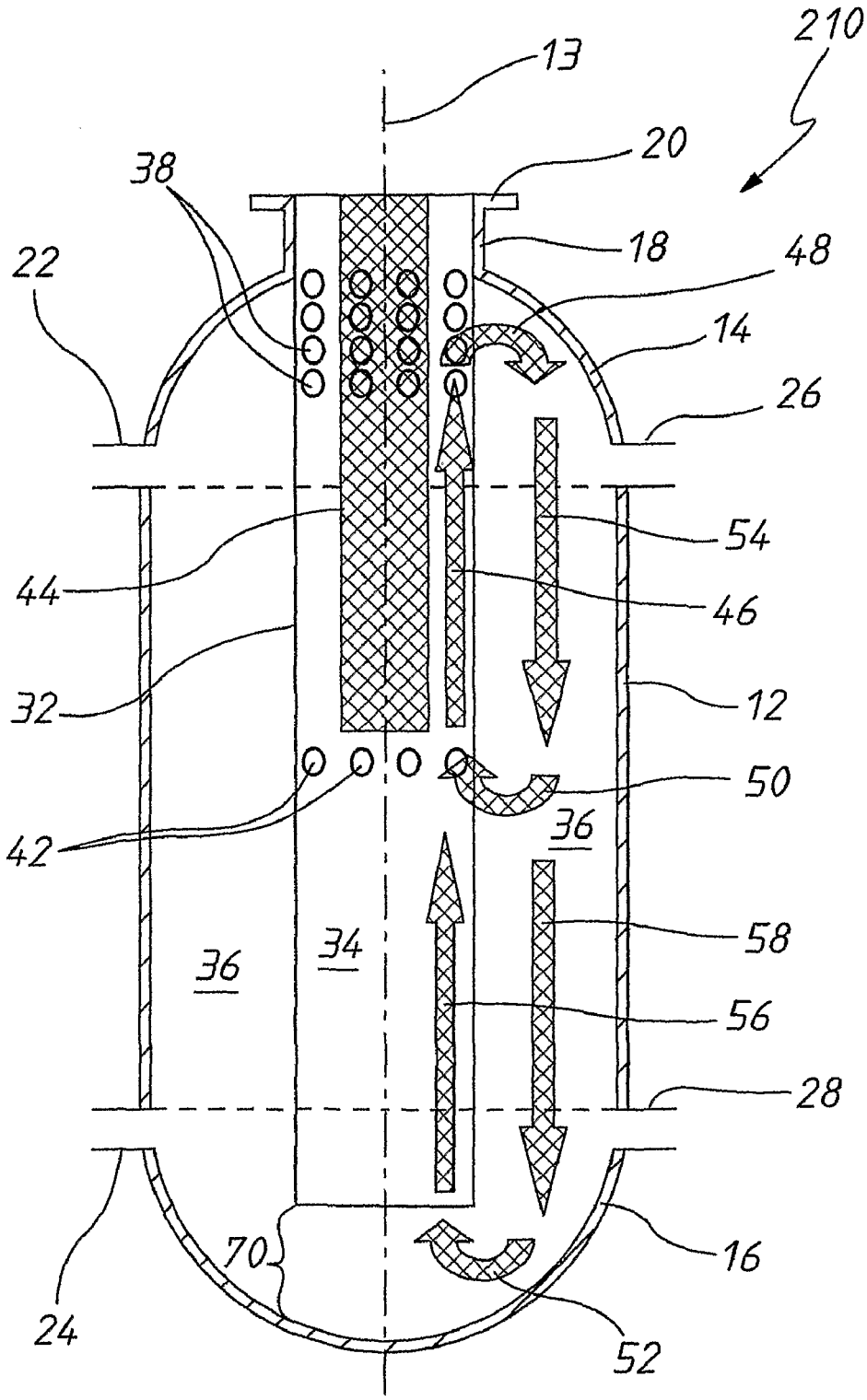
FIG. 5 is a schematic cross-sectional side view of a water heater according to a third embodiment of the invention.

FIG. 5 shows a third embodiment of a water heater 210. Like features in the third embodiment to those used in describing earlier embodiments are indicated with like reference numerals. The water heater 210 is very similar in construction and operation to the water heater 10 shown in FIG. 1 except the duct 32 only extends through about 88% of the tank height and does not extend to the lower domed end 16 of the tank 12. This leaves a gap 70 between the lower end 16 of the duct 32 and the lower end of the tank 12. Water can flow through the gap 70, as indicated by arrow 52, in a similar manner to the water flow through the lower openings 40 shown in FIG. 1. The water heater 210 has a lower material cost than the water heater 10 and is simpler to manufacture.

Figure 6:
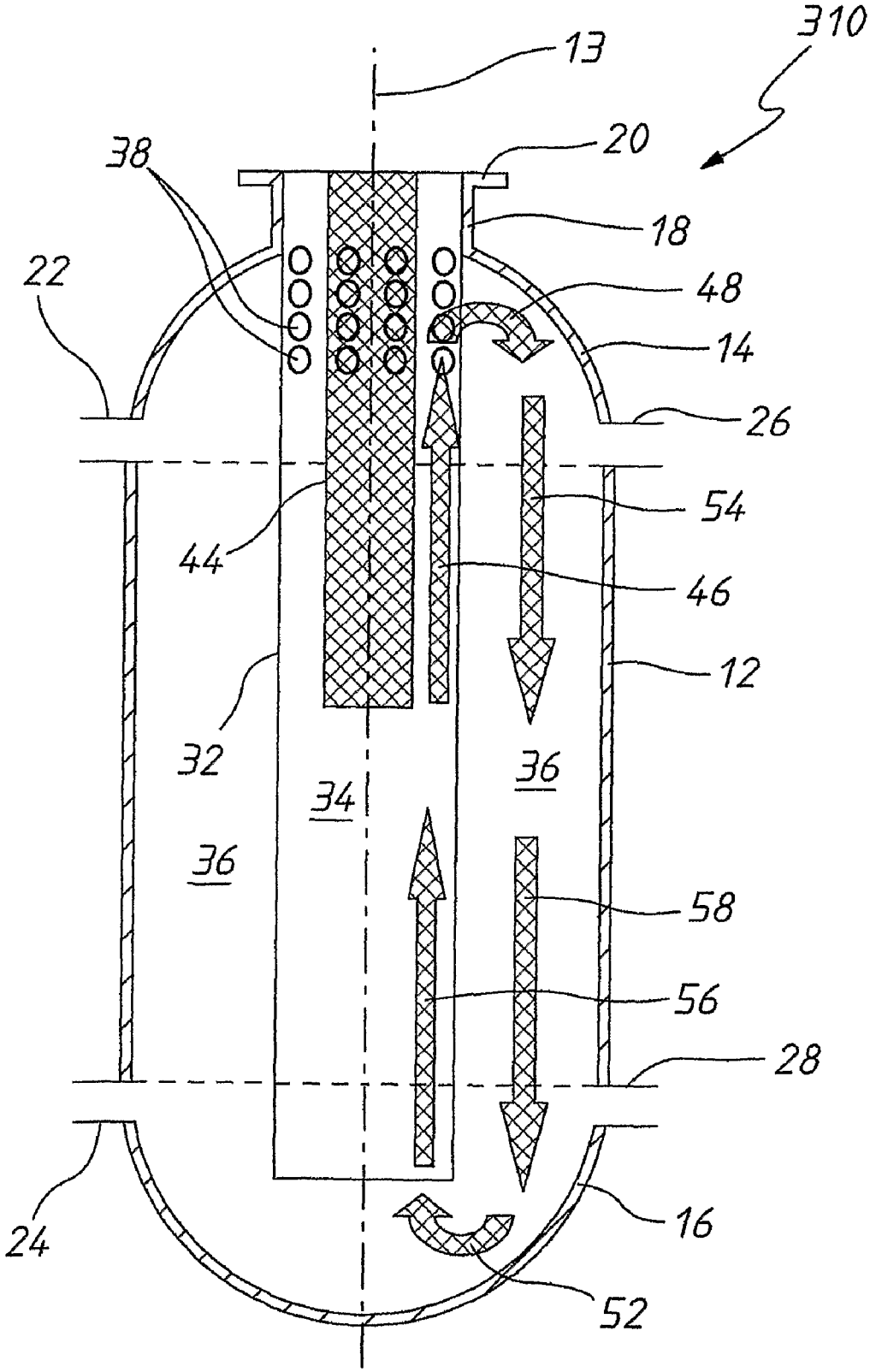
FIG. 6 is a schematic cross-sectional side view of a water heater according to a fourth embodiment of the invention.

FIG. 6 shows a fourth embodiment of a water heater 310. Like features in the fourth embodiment to those used in describing earlier embodiments are indicated with like reference numerals. The water heater 310 is similar in construction and operation to the water heater 210 shown in FIG. 5 except for the absence of the intermediate openings 42. As a result, all water circulation in the heater 310 is from the upper end 14 of the tank 12 to the lower end 10 of the tank 12. The water heater 310 is easier to manufacture than the water heaters 210 or 10 and is best suited for relatively slow water heating using multiple water volume recirculations.

Figure 7:
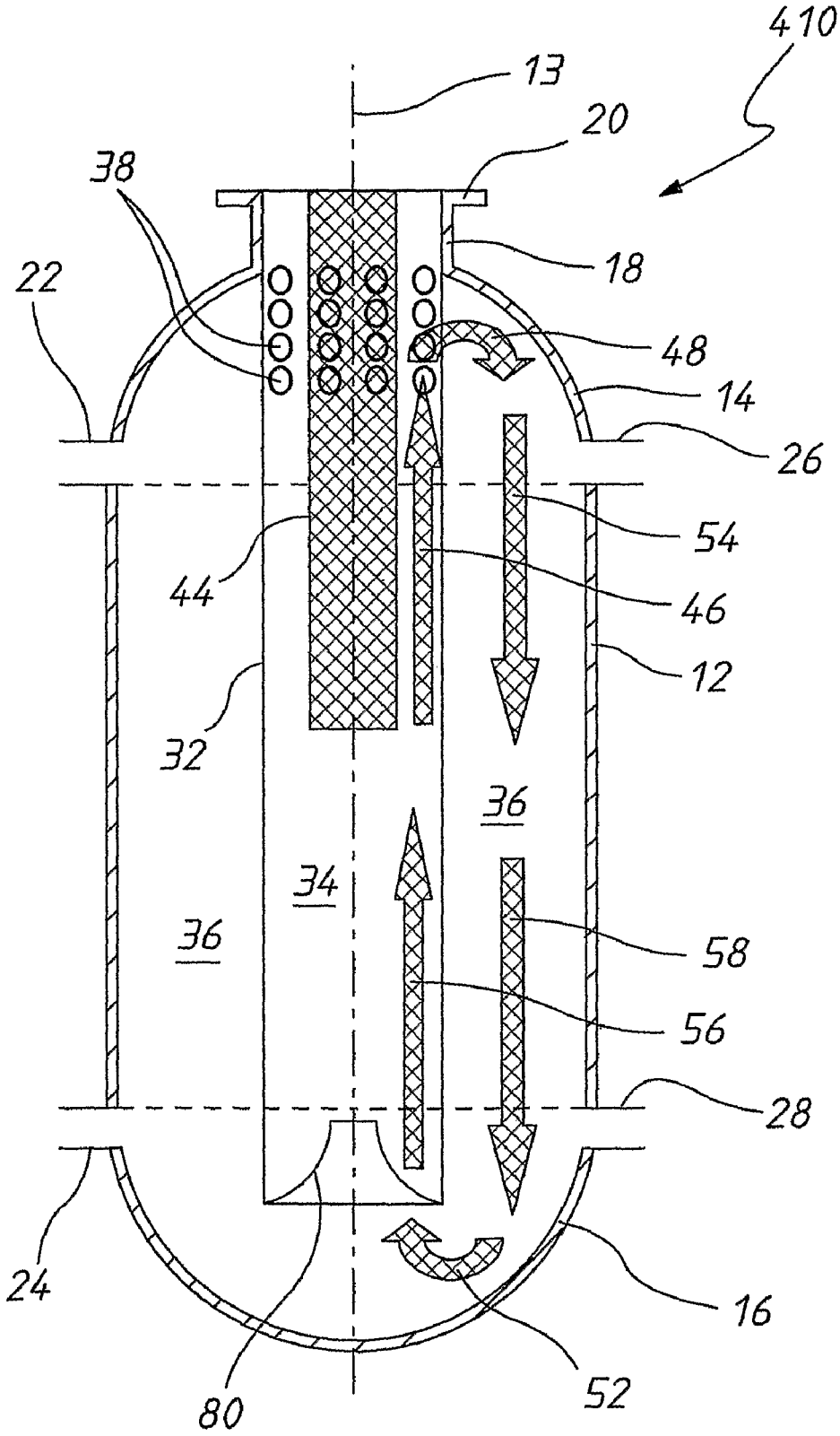
FIG. 7 is a schematic cross-sectional side view of a water heater according to a fifth embodiment of the invention.

FIG. 7 shows a fifth embodiment of a water heater 410. Like features in the fifth embodiment to those used in describing earlier embodiments are indicated with like reference numerals. The water heater 410 is very similar in construction and operation to the water heater 310 shown in FIG. 6 except it has a flow restrictor 80 provided at the lower end of the duct 32. The restrictor 80 serves to slow the flow of water into the duct and thereby increase the amount of time the water is in contact with the heating element 44. As a result, the heater 410 is best suited for providing heated water after only a single water recirculation.

Figure 8:
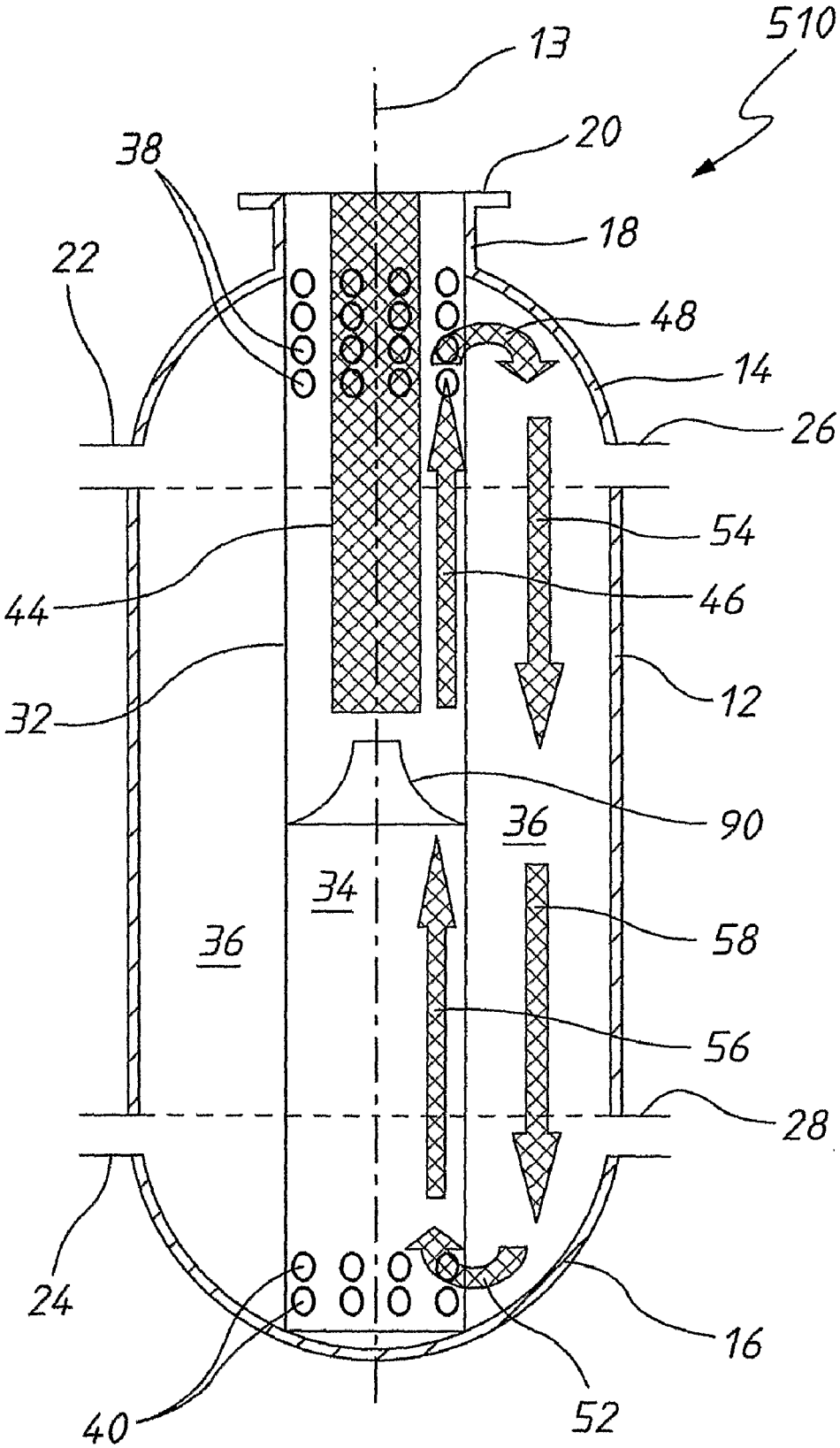
FIG. 8 is a schematic cross-sectional side view of a water heater according to a sixth embodiment of the invention.

FIG. 8 shows a sixth embodiment of a water heater 510. Like features in the sixth embodiment to those used in describing earlier embodiments are indicated with like reference numerals. The water heater 510 is similar in construction and operation to the water heater 410 shown in FIG. 7 except the intermediate openings 42 are replaced with a flow restrictor 90. As with the flow restrictor 80 shown in FIG. 7, the flow restrictor 90 serves to slow the flow of water upwardly through the duct 32 to increase the time the water is in contact with the heating element 44. This results in a water heater able to provide heated water to its outlet 22 (or outlets 22 and 26) after only a single recirculation or pass over the full height of the tank 12.

Figure 9A:
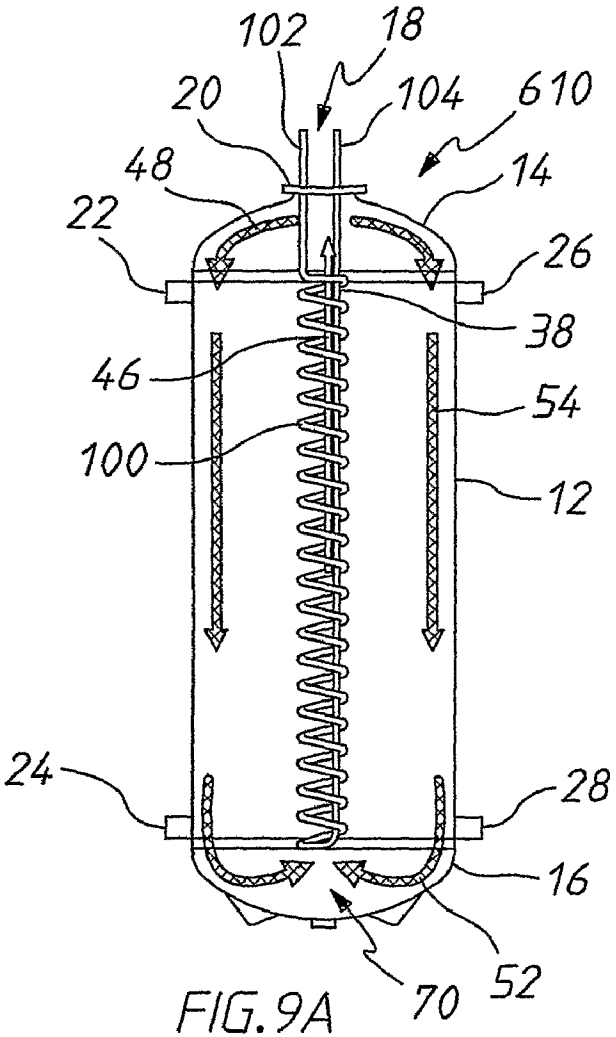
FIG. 9A is a schematic cross-sectional side view of a water heater according to a seventh embodiment of the invention.
Figure 9B:
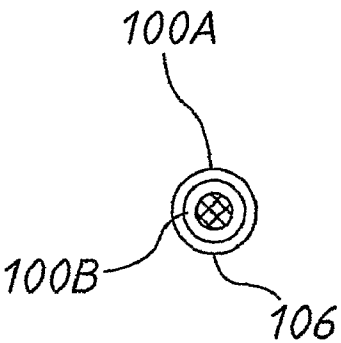
FIG. 9B is a schematic cross-sectional end view of a heating element used in the water heater shown in FIG. 9A.

FIG. 9A shows a seventh embodiment of a water heater 610. Like features in the seventh embodiment to those used in describing earlier embodiments are indicated with like reference numerals. The water heater 610 is similar in construction and operation to the water heater 510 shown in FIG. 8, except the heating element and the duct are formed from a single component, namely a hollow tube 100 that is tightly spiraled into a general cylindrical shape. The tight spiraling of the tube 100 causes it to act as a duct and divide the internal volume of the tank into the first volume 34 and the second volume 36. The tube 100 has an inlet 102 and an outlet 104 and is heated to heat the water in the tank 12 by having a heated fluid 106 pumped therethrough. FIG. 9B shows the double walled cross-sectional view construction of the tube 100A and 100B and the heated fluid 106 flowing therethrough. The double walled tube 100 is required to satisfy safety regulations in many jurisdictions. However, in applications where the heated fluid 106 is non toxic and compatible with potable water, the tube 100 may be single walled.

Figure 10:
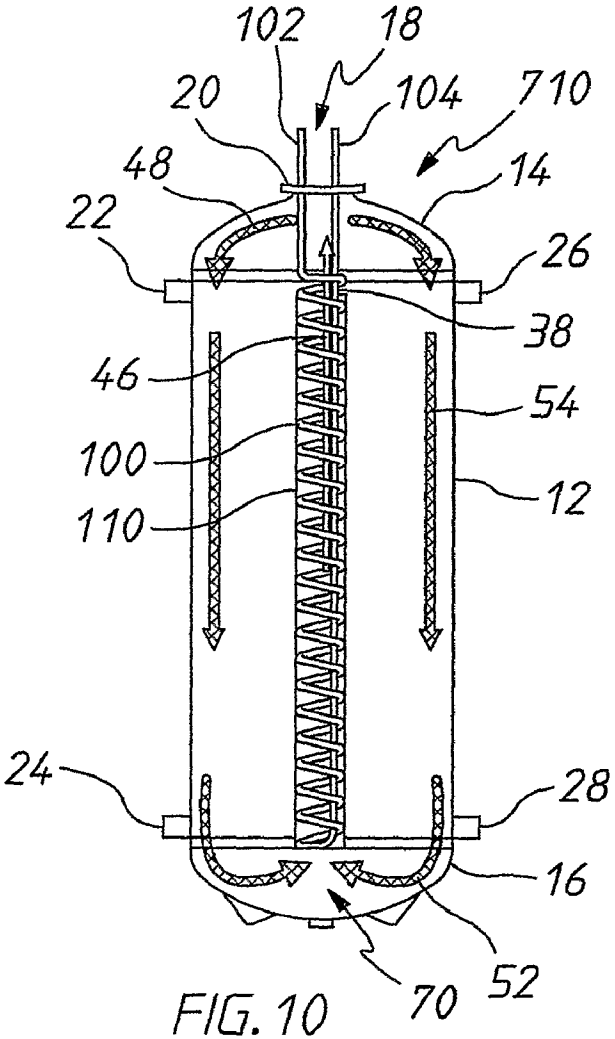
FIG. 10 is a schematic cross-sectional side view of a water heater according to an eighth embodiment of the invention.

FIG. 10 shows an eighth embodiment of a water heater 710. Like features in the eighth embodiment to those used in describing earlier embodiments are indicated with like reference numerals. The water heater 710 is similar in construction and operation to the water heater 610 shown in FIG. 9A except the tube 100 has an external cylinder 110 on its exterior surface to increase the conduction area of the heating element 100 and thereby amplify the upward flow of water through same.

Figure 11:
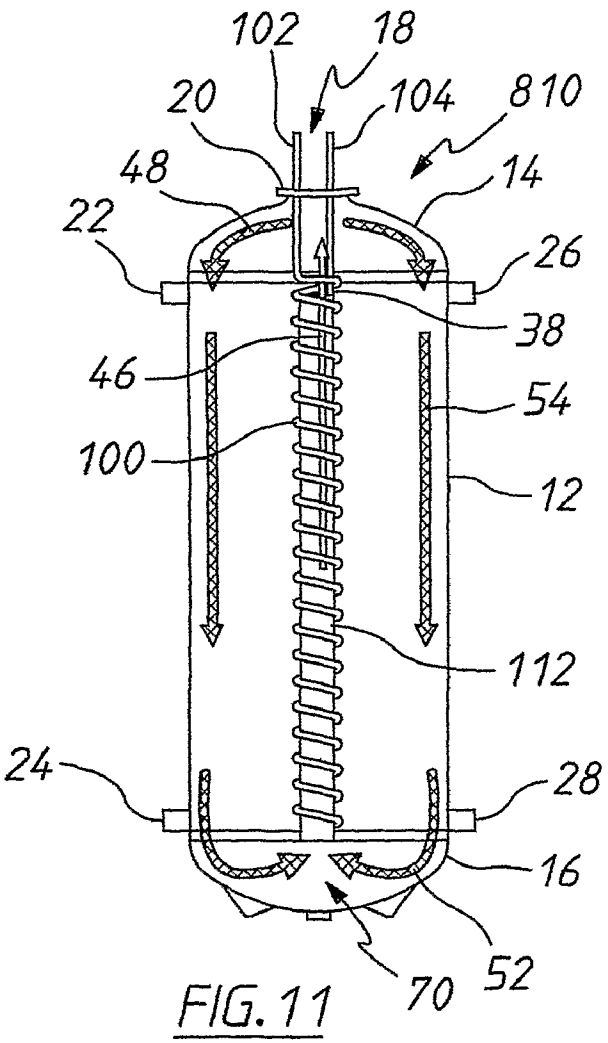
FIG. 11 is a schematic cross-sectional side view of a water heater according to a ninth embodiment of the invention.

FIG. 11 shows a ninth embodiment of a water heater 810. Like features in the ninth embodiment to those used in describing earlier embodiments are indicated with like reference numerals. The water heater 810 is similar in construction and operation to the water heater 610 shown in FIG. 9A, except the tube 100 has an internal cylinder 112 on its interior surface to increase the conduction area of the heating element 100 and thereby amplify the upward flow of water through same.

Figure 12:
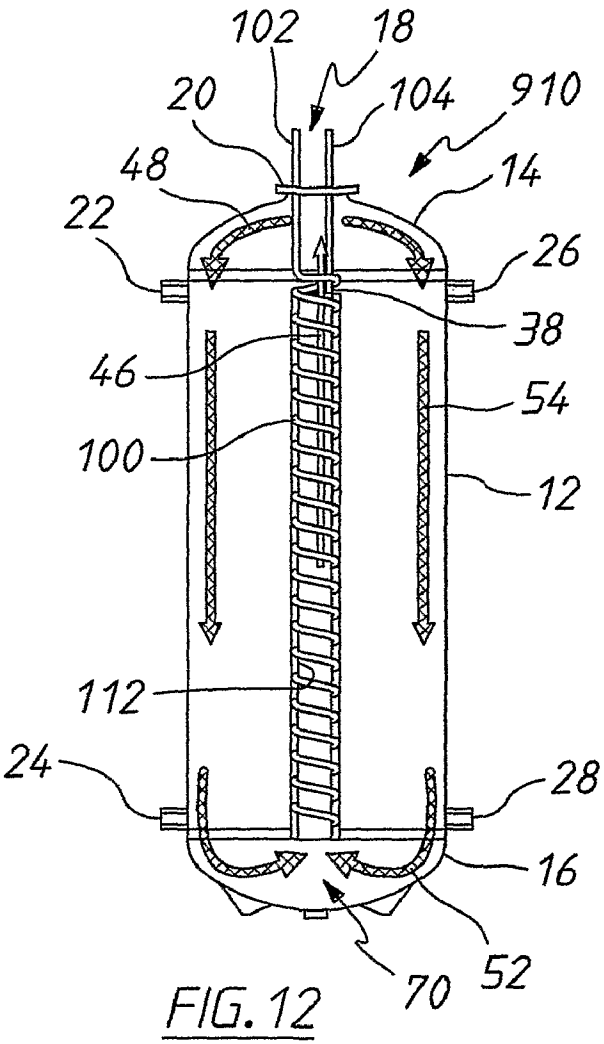
FIG. 12 is a schematic cross-sectional side view of a water heater according to a tenth embodiment of the invention.

FIG. 12 shows a tenth embodiment of a water heater 910. Like features in the tenth embodiment to those used in describing earlier embodiments are indicated with like reference numerals. The water heater 910 is similar in construction and operation to the water heater 610 shown in FIG. 9A, except the tube 100 has both the external cylinder 110 on its exterior surface and the internal cylinder 112 on its interior surface to increase the conduction area of the heating element 100 and thereby amplify the upward flow of water through same. Further, sealing the top and the bottom edges of the cylinders 110, 112 to each other allows the tube 100 to be single walled, yet still satisfy the safety criteria of a double walled heat exchanger.

Although the invention has been described with reference to preferred embodiments, it would be appreciated by those persons skilled in the art that the invention may be embodied in many other forms.

The invention claimed is:

1. A water heater including:

a tank adapted for mounting with its longitudinal axis substantially vertical;

a duct adapted for mounting, with its longitudinal axis substantially vertical, within the tank and extending through at least most of the height of the tank, the duct defining a first volume within the duct interior and a second volume between the duct exterior and the tank interior, the first volume being smaller than the second volume, the duct having at least one upper opening at or near the top of the duct and at least one lower opening at or near the bottom of the duct;

a heating element within, or forming all or part of, the duct, the element extending at least substantially through the upper half of the duct;

an inlet at or near the bottom of the tank; and an outlet at or near the top of the tank, wherein, in use, energising the heater element causes water to flow from the first volume to the second volume through the upper opening(s) and water to flow the second volume to the first volume through the lower opening(s), wherein the heating element forms the duct and vice versa, and wherein the heating element is generally cylindrical in shape and formed from a tightly spiralled hollow tube adapted for having heated fluid flowing therethrough.

2. The water heater as claimed in claim 1, wherein the heating element is separate from, and positioned within, the duct.

3. The water heater as claimed in claim 2, wherein the duct is an open ended cylinder with the heating element positioned within the interior of the cylinder.

4. The water heater as claimed in claim 1, wherein the tightly spiralled hollow tube has an open ended cylinder on its exterior surface.

5. The water heater as claimed in claim 1, wherein the tightly spiralled hollow tube has an open ended cylinder on its interior surface.

6. The water heater as claimed in claim 1, wherein the tightly spiralled hollow tube has open ended cylinders on its interior and its exterior surfaces respectively.

7. The water heater as claimed in claim 1, wherein the hollow tube is single walled.

8. The water heater as claimed in claim 1, wherein the hollow tube is double walled.

9. The water heater as claimed in claim 1, wherein the duct extends through all of the tank height and has the lower opening(s) formed therein.

10. The water heater as claimed in claim 9, wherein the duct also includes at least one intermediate opening between the upper and lower openings, wherein, in use, the colder water also flows from the second volume to the first volume through the intermediate openings.

11. The water heater as claimed in claim 10, wherein the intermediate openings are approximately midway between the upper and lower openings.

12. The water heater as claimed in claim 9, wherein the duct includes a flow restrictor between the upper and lower openings.

13. The water heater as claimed in claim 12, wherein the duct includes a flow restrictor at or near said lower opening.

14. The water heater as claimed in claim 1, wherein the duct lower end terminates above the bottom of the tank to leave a gap between the duct lower end and the tank bottom, the gap defining said lower opening(s).

15. The water heater as claimed in claim 14, wherein the duct extends through about 70-90% of the height of the tank.

16. The water heater as claimed in claim 14, wherein the duct also includes at least one intermediate opening between the upper and lower openings, wherein, in use, the colder water also flows from the second volume to the first volume through the intermediate openings.

17. The water heater as claimed in claim 14, wherein the duct includes a flow restrictor between the upper and lower openings.

18. The water heater as claimed in claim 1, wherein the tank has two outlets at or near the top of the tank.

19. The water heater as claimed in claim 1, wherein the tank o has two inlets at or near the bottom of the tank.

20. The water heater as claimed in claim 1, wherein the duct is adapted for mounting with its longitudinal axis common with the longitudinal axis of the tank.

21. The water heater as claimed in claim 1, wherein the tank includes an opening in one end adapted to allow passage of the duct therethrough.

22. The water heater as claimed in claim 21, wherein the tank opening is in the upper end.

23. A water heater including:

a tank adapted for mounting with its longitudinal axis substantially vertical;

a duct adapted for mounting, with its longitudinal axis substantially vertical, within the tank and extending through at least most of the height of the tank, the duct defining a first volume within the duct interior and a second volume between the duct exterior and the tank interior, the first volume being smaller than the second volume, the duct having at least one upper opening at or near the top of the duct and at least one lower opening at or near the bottom of the duct;

a heating element within, or forming all or part of, the duct, the element extending at least substantially through the upper half of the duct;

an inlet at or near the bottom of the tank; and an outlet at or near the top of the tank, wherein, in use, energising the heater element causes water to flow from the first volume to the second volume through the upper opening(s) and water to flow the second volume to the first volume through the lower opening(s), wherein the duct extends through all of the tank height and has the lower opening(s) formed therein, wherein the duct also includes at least one intermediate opening between the upper and lower openings, wherein, in use, the colder water also flows from the second volume to the first volume through the intermediate openings, and wherein there are a first plurality of upper openings, a second plurality of lower openings, and a third plurality of intermediate openings.

24. The water heater as claimed in claim 23, wherein the total size of the upper openings is approximately double the total size of the lower openings and quadruple the total size of the intermediate openings.

25. The water heater as claimed in claim 23, wherein all of the openings are the same size and the first plurality is approximately 25% larger than the combined total of the second and third pluralities.

26. A method of operating a water heater, the heater including:

a tank adapted for mounting with its longitudinal axis substantially vertical;

a duct adapted for mounting, with its longitudinal axis substantially vertical, within the tank and extending through at least most of the tank height, the duct defining a first volume within the duct interior and a second volume between the duct exterior and the tank interior, the first volume being smaller than the second volume, the duct having openings therein;

a heating element within, or forming part of, the duct, the element extending at least substantially through the upper half of the duct;

an inlet at or near the bottom of the tank; and an outlet at or near the top of the tank, the method comprising the steps of:

admitting colder water through the inlet;

energising the heater to heat the water in the first volume;

directing the hotter water from the first volume to the second volume at or near the top of the duct;

directing colder water in the second volume to the first volume at or near the bottom of the duct; and directing colder water in the second volume to the first volume via a flow restrictor at or near the middle of the duct, thereby providing hotter water at the outlet.

27. The water heater as claimed in claim 26, wherein the method also includes the step of directing colder water in the second volume to the first volume via a flow restrictor at or near the bottom, of the duct.

28. The water heater as claimed in claim 26, wherein the method also includes the step of directing colder water in the second volume to the first volume at or near the middle of the duct.

* * * * *

UNITED STATES PATENT AND TRADEMARK OFFICE

CERTIFICATE OF CORRECTION

PATENT NO. : 7,997,236 B2
APPLICATION NO. : 11/575991
DATED : August 16, 2011
INVENTOR(S) : Patrick Pussell It is certified that error appears in the above-identified patent and that said Letters Patent is hereby corrected as shown below:

Column 8, line 30, Claim 19, please remove the "o" before "has".

Signed and Sealed this
Twenty-second Day of November, 2011

David J. Kappos

David J. Kappos
*Director of the United States Patent and Trademark Office*